US010232527B2

(12) United States Patent
Soler Balcells

(10) Patent No.: US 10,232,527 B2
(45) Date of Patent: Mar. 19, 2019

(54) CUTTING AND SEPARATION HEAD FOR MANUAL CERAMICS CUTTERS

(71) Applicant: GERMANS BOADA, S.A., Rubi (Barcelona) (ES)

(72) Inventor: Jordi Soler Balcells, Rubi (ES)

(73) Assignee: GERMANS BOADA, S.A., Rubi (Barcelona) (ES)

( * ) Notice: Subject to any disclaimer, the term of this patent is extended or adjusted under 35 U.S.C. 154(b) by 0 days.

(21) Appl. No.: 15/559,721

(22) PCT Filed: Feb. 17, 2016

(86) PCT No.: PCT/ES2016/070099

§ 371 (c)(1),
(2) Date: Sep. 19, 2017

(87) PCT Pub. No.: WO2016/151162

PCT Pub. Date: Sep. 29, 2016

(65) Prior Publication Data

US 2018/0093393 A1 Apr. 5, 2018

(30) Foreign Application Priority Data

Mar. 20, 2015 (ES) ..... 201500225

(51) Int. Cl.
*B28D 1/22* (2006.01)

(52) U.S. Cl.
CPC ..... *B28D 1/225* (2013.01)

(58) Field of Classification Search
CPC ..... B28D 1/22; B28D 1/222; B28D 1/223; B28D 1/225; B28D 1/226
See application file for complete search history.

(56) References Cited

U.S. PATENT DOCUMENTS 5,303,690 A * 4/1994 Ishii ..... B28D 1/225 125/23.01
6,164,272 A * 12/2000 Fouy ..... B28D 1/225 125/12

FOREIGN PATENT DOCUMENTS

| | | | |
|---|---|---|---|
| EP | 494578 | A1 * | 7/1992 |
| EP | 0501053 | A1 | 9/1992 |
| EP | 592345 | A2 * | 4/1994 |
| EP | 2524784 | A1 * | 11/2012 |
| ES | 2017197 | A6 | 1/1991 |
| ES | 2101611 | A1 | 7/1997 |
| ES | 1042563 | U | 9/1999 |
| ES | 1044402 | U | 5/2000 |

OTHER PUBLICATIONS

International Search Report dated Apr. 8, 2016 of corresponding International application No. PCT/ES2016/070099; 4 pgs.

* cited by examiner

*Primary Examiner* — Stephen Choi
(74) *Attorney, Agent, or Firm* — Maier & Maier, PLLC

(57) ABSTRACT

A cutting and separation head for manual ceramic cutters, including a body that carries a grip handle and a cutting tool, mounted on movable supports on longitudinal guides of the cutter, and able to rotate with respect to a first transverse rotary shaft; a separator provided with a foot, a class 1 lever, and a first coupling element in the separator that is couplable to a second coupling element in the body of the head; and a cam for releasing the first and second coupling elements, the cam being mounted on the body and relatively rotatable between a first position and a second position.

4 Claims, 5 Drawing Sheets

CUTTING AND SEPARATION HEAD FOR MANUAL CERAMICS CUTTERS

OBJECT OF THE INVENTION

The object of the present invention is a cutting and separation head for manual ceramic cutters that has particular constructive characteristics intended to simplify the actuation of the separator, allowing it to be arranged in an operative position or inoperative position by only changing the inclination of the head.

FIELD OF APPLICATION OF THE INVENTION

This invention is applicable to manual ceramic cutters.

STATE OF THE ART

Currently, manual ceramic cutters having a base with a support surface for the ceramic parts to be cut and at least one longitudinal guide in which a cutting and separation head for the manual ceramic parts to be cut, which are disposed on the base, is mounted by means of a corresponding movable runner or support.

These cutting and separation heads have a body mounted on the movable runners or supports by means of a transverse rotary shaft, that is, the shaft is perpendicular to the longitudinal guides of the cutter. It is known that said cutting and separation head has a handle for gripping and handling thereof on a first end; the head further comprising a cutting tool for scratching or scoring the ceramic parts to be cut and a separator for fracturing and separating the ceramic part along the longitudinal cutting line previously scored by the cutting tool.

Currently known manual ceramic cutters have separators with different configurations, each sharing a common characteristic consisting of the fact that the operator should manually act on the separator to place it in an inoperative position during the cutting or scratching operation of the ceramic part by means of the cutting tool, or to place it in an operative position in which it is disposed under the cutting tool so that it acts on the ceramic part to be separated.

Thus, for example, in the utility model ES 1062584 U, the separator is basically formed by a foldable part that is directly mounted on it and by means of a rotary shaft on the handle/head of the cutter.

In the utility model ES 1042563 U, the cutter is also directly mounted by means of a rotary shaft on the body of the head, said separator being connected to a positioning mechanism mounted on the actuation lever or handle of the head and which includes a cylinder-operated sliding mechanism, a sleeve and a spring joined together by means of a connecting rod to feet that integrate the separator.

The direct mounting of the separator on the cutting head by means of a rotary shaft means that the user should apply a significant force to separate the ceramic parts along the cutting line previously defined by the cutting tool.

Another drawback of these separators is that the disposition thereof in the operative position or in the inoperative position requires the manual actuation thereof by the user, which requires the user to use both hands, one to hold the handle of the head and the other to change the position of the separator, thus preventing the user from manually holding the ceramic part in a secured position during the time that passes between the scoring of the same with the cutting tool and the separation of said part along the cutting line.

DESCRIPTION OF THE INVENTION

The cutting and separation head for manual ceramic cutters object of the present invention, applicable to manual ceramic cutters of the type described above, has characteristics intended to solve the problem set forth which relates to the need of the operator to use both hands to subsequently separate the ceramic parts previously scored by the cutting tool and also relates to the force applied to the handle of the head to separate the ceramic part.

This cutting and separation head for manual ceramic cutters is of the type described in the precharacterizing part of the first claim, comprising movable supports on longitudinal guides of the cutter; a body mounted on said movable supports that can be rotably moved with respect to a first transverse rotary shaft; a grip handle secured to a first end of the body; a cutting tool and a separator provided with a support foot on the ceramic parts to be separated.

To achieve the objectives proposed, this cutting head comprises a class 1 lever mounted on a second transverse rotary shaft, the lever of which has a first end on which the foot of the separator is articulated and a second, opposite end on which a first coupling element is articulated with the body of the articulated head.

This lever has the purpose of transmitting a force to the foot of the separator that is greater than the force applied by the user to the handle of the head, minimizing the effort needed to separate the ceramic part previously scored by the cutting tool.

The head incorporates at least one spring that acts on the first coupling element and tends to rotate it towards a coupling position with a second coupling element defined in the body of the head, and it automatically establishes coupling of the first coupling element to the second coupling element, the separator being in an operative position, when the body of the head is folded in an ascending direction, exceeding a first angle of inclination above the horizontal.

This ensures that when the head is disposed with an inclination less than the aforementioned first angle, the head remains in an operative cutting position, and when the head is folded towards the upper zone, exceeding said first angle, this occurs automatically, without requiring the operator to manipulate the coupling of the first coupling element to the second coupling element, the cutter being positioning in an operative position to separate the ceramic part.

Once coupling of the first coupling element to the second coupling element is established, the cutter will remain in an operative position to separate the ceramic parts while the body of the head is held at an inclination greater than that said first angle and smaller than a second larger angle.

In order for the operator to be able to automatically return the head to a cutting position, one only needs to act on the handle of the head, folding it towards the upper area until it reaches the aforementioned second angle, and then subsequently lower it until the body of the head reaches an inclination smaller than the first angle.

To automatically change the separation position of the head to the cutting position, the head comprises a cam for releasing the first and second coupling elements, the cam being mounted on the body and relatively rotatable between a first position and a second position.

This cam automatically acts on the first coupling element, releasing it from the second coupling element when the head of the body is folded in an ascending direction and reaches the second angle mentioned above; it keeps the first coupling element away from the path of the second coupling element, and subsequently decouples it when the body of the head is folded in a descending direction; said cam automatically releases the first coupling element when the body of the head reaches an inclination smaller than the first smaller angle.

In this invention, it is also provided that the first and/or second coupling element has several successive coupling points in order to apply greater or lesser force to the handle of the head, a force which is transmitted to the foot of the separator.

In a specific embodiment of the invention, these and other characteristics of the invention will be better understood in view of the exemplary embodiment shown in the attached figures.

DESCRIPTION OF THE FIGURES

As a complement to the description provided herein, and for the purpose of helping to make the characteristics of the invention more readily understandable, the present specification is accompanied by a set of drawings, which, by way of illustration and not limitation, represent the following.

PREFERRED EMBODIMENT OF THE INVENTION

Figure 1:
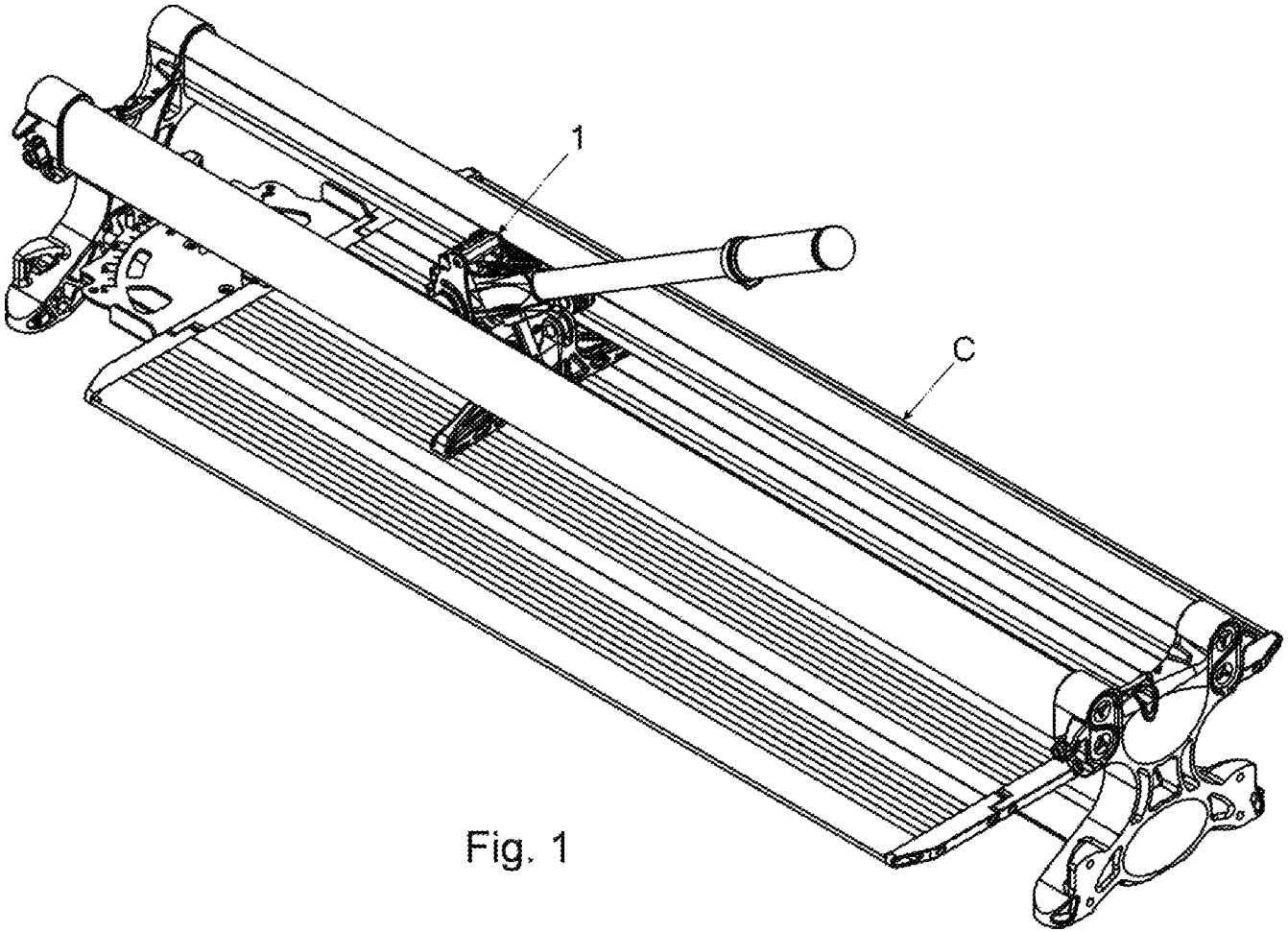
FIG. 1 shows a schematic perspective view of an exemplary embodiment of the cutting and separation head, according to the invention, applied to a manual ceramic cutter.

In FIG. 1, an exemplary embodiment of the cutting and separating head (1) of ceramic parts mounted on a manual ceramic cutter (C) that can be moved along longitudinal guides disposed in parallel above the base of the cutter can be observed.

Figure 2:
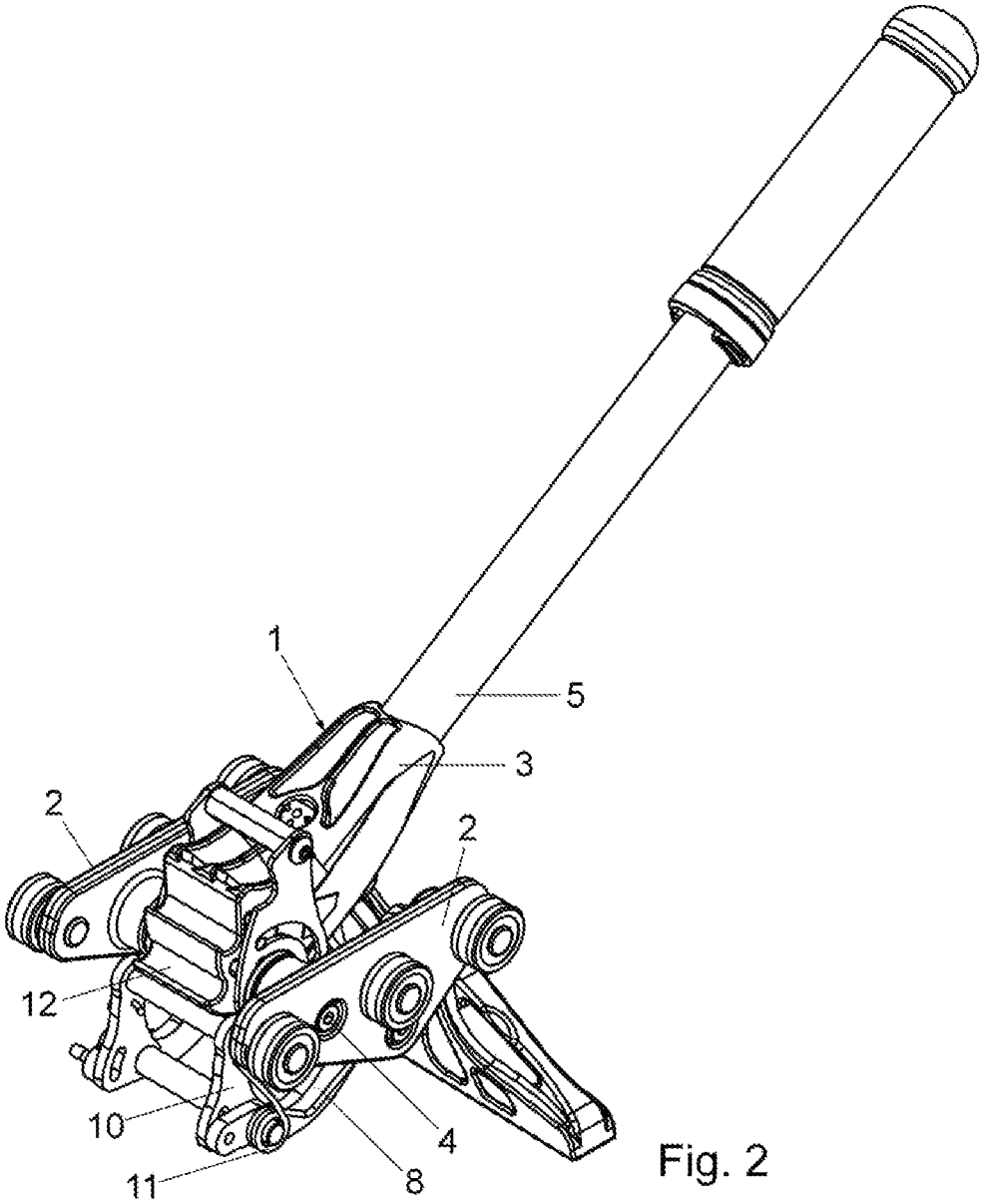
FIG. 2 shows a perspective view of the cutting and separation head in which the first coupling element is formed by a stirrup and the second coupling element is formed by a tooth defined in the body of the head.

In the example shown in FIG. 2, an exemplary embodiment of the head (1) that comprises supports (2) on its sides, which in this case are made up of runners for the movement thereof along the guides of the cutter and a body (3) mounted on the supports (2) and which can be rotated with respect to a first transverse shaft (4), can be observed. The body (3) has a handle (5) secured to a first end thereof.

As can be observed more clearly in FIGS. 3 to 7, the body (3) has on the lower end thereof a cutting tool (6) for longitudinal scratching and to define a cutting line on a ceramic part (P) positioned on the base of the cutter.

The head (1) additionally has a separator for the ceramic parts (P) to be separated along the scored line defined by the cutting tool (6).

This separator comprises a foot (7) intended to press the ceramic part (P) to be cut in order to produce the separation thereof, said foot (7) being articulated by means of a rotary shaft on a first end of a class 1 lever (8) mounted on the movable supports (2) by means of a second transverse rotary shaft (9).

Figure 3:
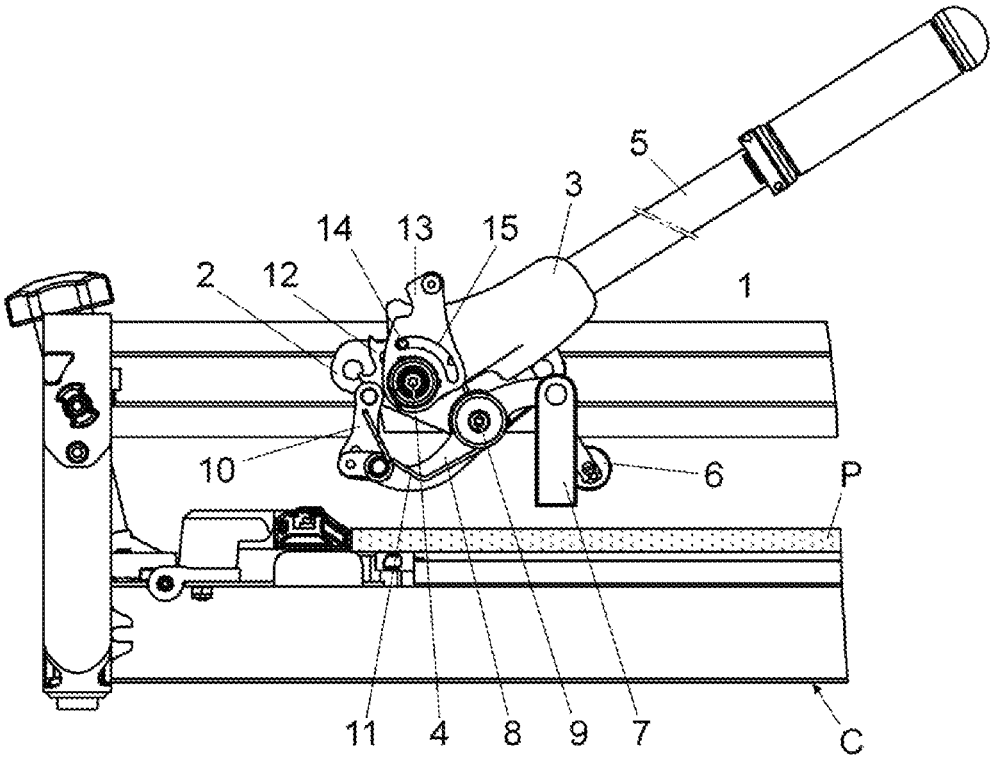
FIG. 3 shows a profile view of the head in which one of the movable supports and the corresponding longitudinal guide of the cutter has been removed, the head in an operative cutting position being able to be observed.

A first coupling element (10) is mounted on the second end of the lever (8) which, in this case, has a stirrup-like configuration, which is pushed by a spring (11), shown in FIGS. 2 and 3, and which tends to push it against a second end of the body (3) in which a second coupling element (12) is defined, in this case formed by a tooth with two different coupling points of the stirrup forming the first coupling element (10).

A cam (13) that is rotatable with respect to the body (3) between a first position and a second position determined by the path of a stop (14) attached to the body (3), along the inside of a curved slot (15) defined in the cam (13), is mounted on the body (3) and specifically on the same first rotary shaft (4).

In the position shown in FIG. 3, the first coupling element (10) is under the second coupling element (12) and therefore released from the same, which enables actuation on the handle (5) so that the body (3) rotates on the first transverse shaft (4) and the cutting tool (6) comes in contact with the ceramic part (P) to be scored, carrying out the scoring of the same by moving the head (1) along the guides of the cutter (C). Therefore, in this FIG. 3, the head (1) is in a cutting position.

Figure 4:
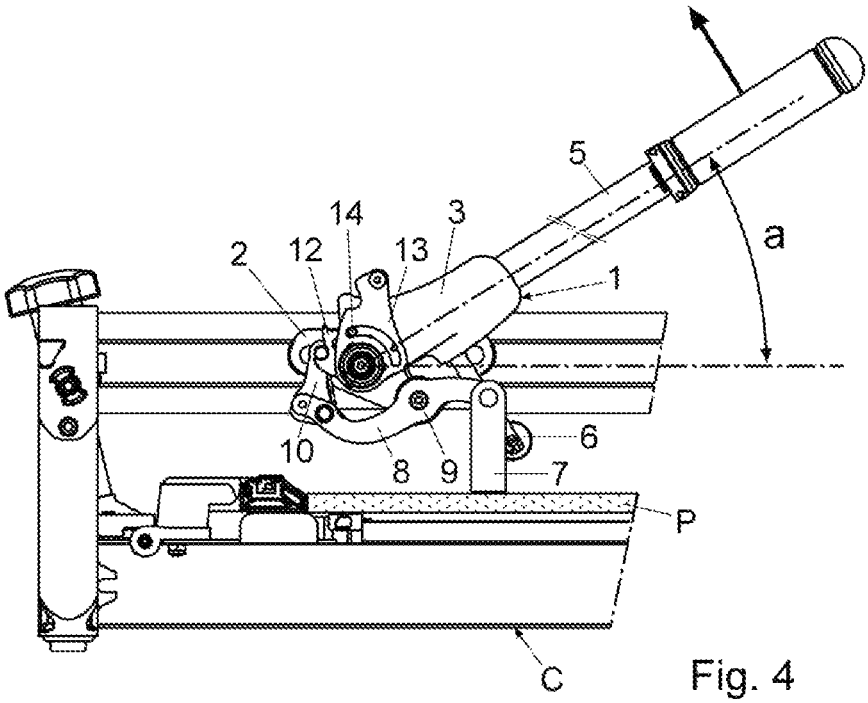
FIGS. 4, 5, 6 and 7 show profile views of the cutting and separation head in different relative positions of the first and second coupling element.

As can be observed in FIG. 4, in order to dispose the head (1) in an operative position to separate the ceramic part (P), one only needs to fold the body (3) of the head (1) in an ascending direction so that it reaches a first angle (a) of inclination above the horizontal, in which the coupling of the stirrup or the first coupling element (10) with one of the teeth of the second coupling element (12) is established.

Once this position is reached, when applying a descending force on the handle, the force is transmitted with a greater intensity to the foot (7) of the separator by means of the first coupling element (10) and the lever (8).

By changing the coupling tooth or point of the first coupling element (10) with respect to the second coupling element (12), a greater or lesser multiplication of the force applied to the handle (5) and transmitted to the foot (7) of the separator is achieved.

Figure 5:
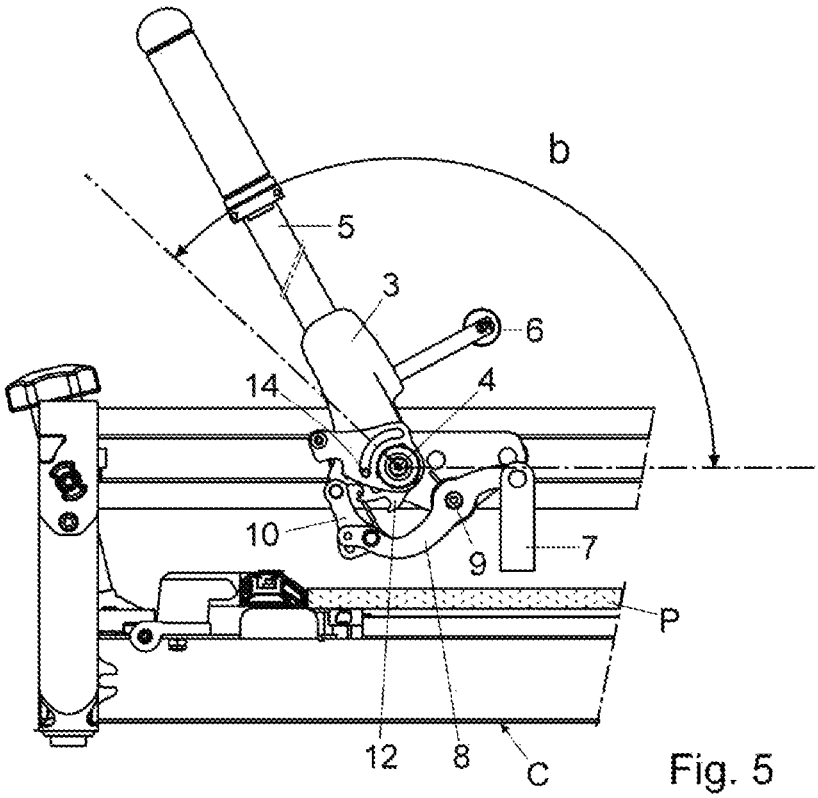

Coupling of the first coupling element (10) to the second coupling element (12) is maintained even if the handle is raised or even if it exceeds the vertical position, as shown in FIG. 5.

Figure 6:
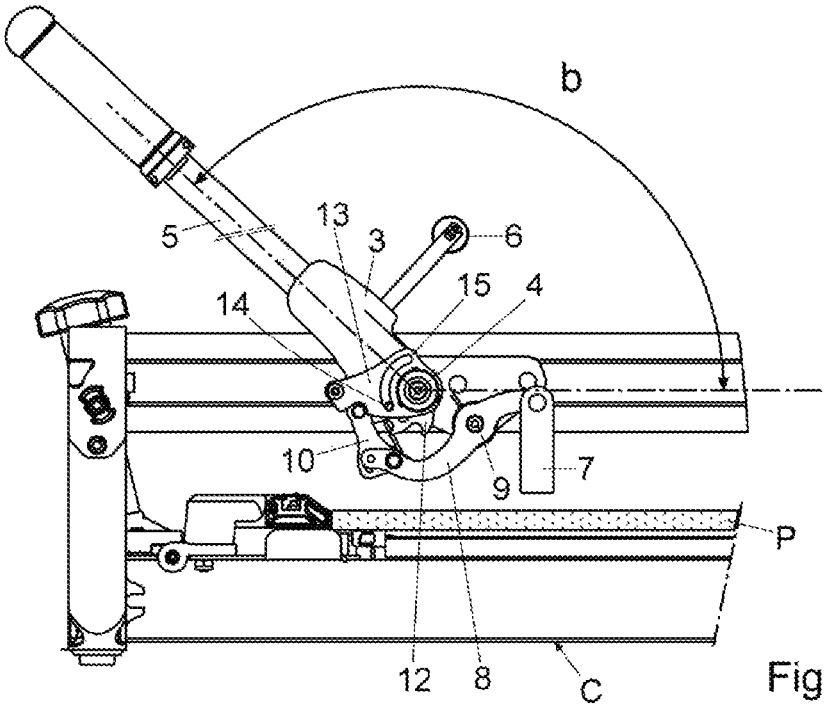

To release the separator and return the head to the cutting position, one only needs to increase the folding angle of the body (3) in an ascending direction until it reaches a second angle (b), shown in FIG. 6, and in which the cam (13) acts on the first coupling element (10), releasing it from the tooth of the second coupling element (12). In an embodiment of the invention, the aforementioned angle (b) is greater than 90°, and it is 105° in a specific example.

Figure 7:
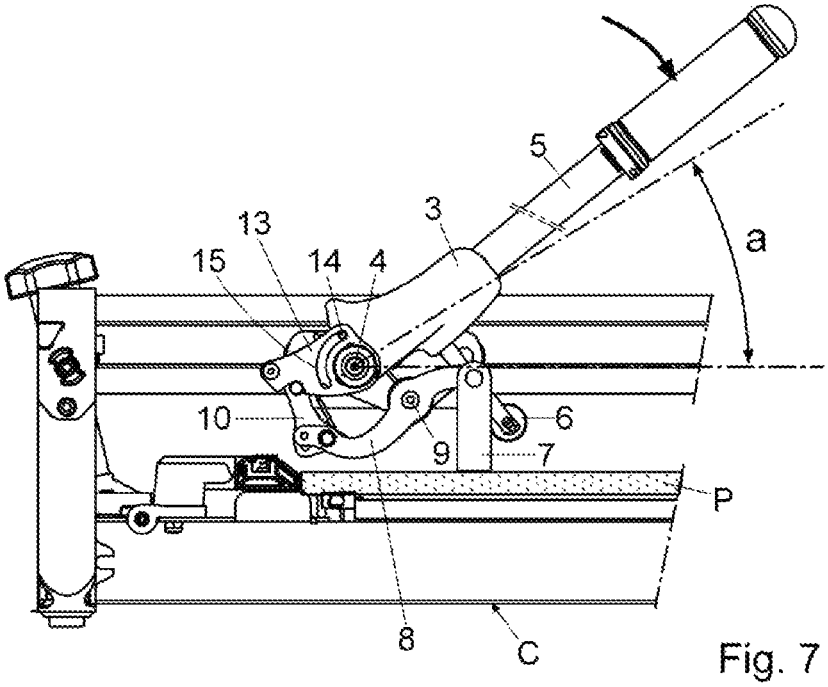

Once this position is reached, one only needs to act on the handle (5) to fold the body (3) of the head (1) in the opposite direction, in other words, in a descending direction, maintaining the cam (13) with the first coupling element (10) away from the path of the second coupling element (12), as observed in FIG. 7.

This cam (13) automatically releases the first coupling element (10), the separator being in the non-operating position shown in FIG. 3, when the body (3) of the head reaches an inclination smaller than the first angle (a), the head (1) returning to the cutting position.

Having sufficiently described the nature of the invention, in addition to an example of a preferred embodiment, it is hereby stated for the relevant purposes that the materials, shape, size and layout of the described elements may be modified, provided that it does not imply altering the essential characteristics of the invention claimed below.

The invention claimed is:

1. A cutting and separation head for manual ceramic cutters comprising:

movable supports on longitudinal guides of a cutter; a body mounted on supports that can be rotatably moved with respect to a first transverse rotary shaft, a grip handle secured to a first end of the body, a cutting tool and a separator provided with a support foot on the ceramic parts to be separated, further comprising:

a class 1 lever mounted on a second transverse rotary shaft, the lever of which has a first end on which the foot of the separator is articulated and a second, opposite end;

a first coupling element articulated on the second end of the lever;

at least one spring that acts on the first coupling element and tends to rotated the first coupling element towards a coupling position with a second coupling element defined in the body of the head, establishing coupling of the first coupling element to the second coupling element and the separator being disposed in an operative position, when the body of the head is folded in an ascending direction, exceeding a first angle of inclination with respect to the horizontal and is maintained at an inclination smaller than a second larger angle; and a cam for releasing the first and second coupling elements, the cam being mounted on the body and relatively rotatable between a first position and a second position, wherein the cam acts on the first coupling element, releasing the first coupling element from the second coupling element when the body is folded in an ascending direction and reaches the second angle, maintains the first coupling element away from the path of the second coupling element when the body of the head is folded in a descending direction and, and releases the first coupling element, the separator being disposed in an inoperative position when the body of the head reaches an inclination smaller than the first angle.

2. The head according to claim 1, wherein the cam is mounted on the first rotary shaft of the body and limited with relative rotation with respect to the body along the path of a stop attached to the body, along an inside of a curved slot defined in the cam.

3. The head according to claim 1, wherein the second larger angle is greater than 70°.

4. The head according to claim 3, wherein the second larger angle is 105°.

* * * * *